United States Patent [19]

Taylor

[11] Patent Number: 4,784,389

[45] Date of Patent: Nov. 15, 1988

[54] BASEBALL BATTING PRACTICE DEVICE

[75] Inventor: Roger Taylor, St. Clair Shores, Mich.

[73] Assignee: Anthony C. Capolingua, Troy, Mich.; a part interest

[21] Appl. No.: 932,577

[22] Filed: Nov. 20, 1986

[51] Int. Cl.[4] ..... A63B 69/40

[52] U.S. Cl. ..... 273/26 E; 273/26 B; 273/58 C

[58] Field of Search ..... 273/26 B, 26 R, 29 A, 273/72 R, 26 E, 413, 414; 242/48.1, 84.1 M

[56] References Cited

U.S. PATENT DOCUMENTS

| | | | |
|---|---|---|---|
| 1,603,904 | 10/1926 | Cohn | 273/72 |
| 2,128,610 | 8/1938 | Heimers | 273/26 B |
| 2,944,817 | 7/1960 | Stiller | 273/26 |
| 3,376,037 | 4/1968 | Lepselter | 273/26 B |
| 3,635,475 | 11/1972 | Brown | 273/26 E |
| 3,909,949 | 10/1975 | Miyamae | 242/84.1 M |
| 4,044,968 | 8/1977 | Scott | 242/84.1 M |
| 4,124,174 | 11/1978 | Kelly | 242/84.1 M |
| 4,526,374 | 7/1985 | Ban | 273/194 R |
| 4,600,190 | 7/1986 | Berokoff | 273/26 B |
| 4,634,072 | 1/1987 | Stealy | 242/84.1 M |

*Primary Examiner*—Richard C. Pinkham
*Assistant Examiner*—T. Brown
*Attorney, Agent, or Firm*—Basile and Hanlon

[57] ABSTRACT

A baseball batting practice device is disclosed as a bat having a recess formed at the large end to nestingly receive a spinning reel. The reel is oriented to pay-out a fishing line at a right angle to the bat axis, the fishing line is secured to a baseball and serves as a tether to retrieve the ball using the reel. With the tether payed out at a right angle to the bat axis, minimum resistance to the flight of the ball is observed and the distance traveled by the ball replicates that of an untethered ball.

1 Claim, 1 Drawing Sheet

BASEBALL BATTING PRACTICE DEVICE

BACKGROUND OF THE INVENTION

Field of the Invention

This invention relates to a baseball batting practice device with a retrievable ball tethered to the bat.

Effective baseball batting practice requires the use of equipment that closely simulates the situation under which actual playing conditions occur. The feel and swing weight of the bat, for example, should be close as possible to the bat used on the playing field. Furthermore, the ball when struck by the bat should fly from the bat in a manner similar to that which would occur in an identical contact between the bat and ball in an actual game situation.

Ideally, the person engaged in batting practice should be able to take a considerable number of batting practice swings at the ball in a short period and observe the reaction of the ball to the contact with the bat. Any shortcomings, as a result of the bat striking the ball in an inappropriate manner, can be quickly corrected if the person engaged in batting practice is able to retrieve the ball in a timely manner and correct his method of striking the ball. Normally, a person engaged in batting practice would strike the ball walk a considerable distance to retrieve the ball, and then strike it again. This does not enable the person engaged in batting practice to hit a large number of balls in a given period of time.

This invention enables a baseball enthusiast to bat a large number of balls in a short space of time without expending a great deal of time and energy walking from where the ball is struck to where the ball lands.

Description of the Prior Art

Sports practice equipment using a tethered ball and a retrieving reel are known in the art. U.S. Pat. Nos. 4,526,374; 3,635,475; 3,376,037; 2,944,817; and 2,128,610 disclose a ball tethered to a striking apparatus and a retrieval means. These devices restrain the flight of the ball by use of elastic devices or other friction means. These devices produce a less than satisfactory result since the flight of the ball is reduced by the friction imposed on the tether. The friction imposed on the tether also requires a stronger tether to keep the line from breaking, which further diminishes the ability of the device to replicate the flight of an untethered ball. In each of the above U.S. patents, the flight of the ball from the striking aparatus is at right angles to the direction in which the reel pays out the tether. This further restricts the distance the ball will travel when struck and requires a stronger tether.

The prior art devices alter the swing weight and feel of the striking device by the addition of weight to the striking device with no compensating weight removed to keep the bat or club at its original natural swing weight.

SUMMARY OF THE INVENTION

The present invention overcomes the before mentioned deficiencys for batting practice devices and allows a close simulation of the swing weight and feel of a conventional baseball bat, contributing to a close replication of the flight of the ball when struck by a conventional bat.

It is therefore a feature of this invention to provide a convenient and easily operated apparatus for baseball batting practice.

It is a further purpose of this invention to provide the user with a device that enables him to strike the ball a large number of times in a given period and not have to walk to retrieve the ball.

It is a further object of this invention to provide an adjustment in the swing weight of the bat so that the bat retains the feel of a conventional bat.

It is a further object of the present invention to provide a step-up gear device to speed up the retrieval of the tethered ball.

It is yet another object of the present invention to provide a counting device which measures the distance the tethered ball has traveled.

Further objects, advantages, and applications of the present invention will become apparent to those skilled in the art of baseball batting practice devices when the accompanying description of one example of the best mode contemplated for practicing the invention is read in conjunction the accompanying drawing.

BRIEF DESCRIPTION OF THE DRAWING

The description herein makes reference to the accompanying drawing wherein like reference numbers refer to like parts throughout the various several views, and wherein.

DESCRIPTION OF THE PREFERRED EMBODIMENTS

Figure 1:
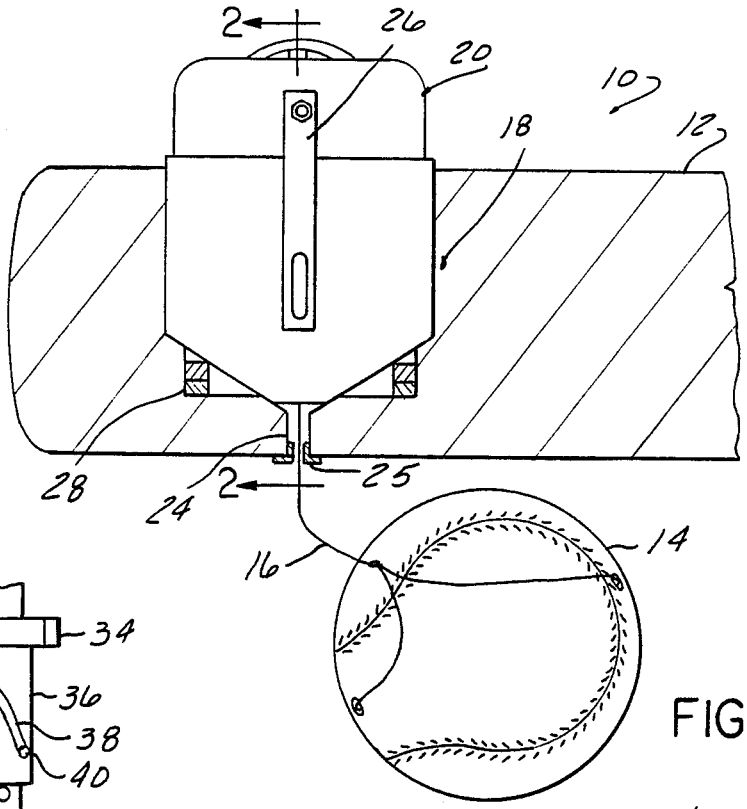
FIG. 1 illustrates a broken cross-sectional view of the bat and reel sectioned along the axis of the bat.

Referring now to the drawing, there is illustrated in FIG. 1 an example of the present invention in the form of a batting practice device 10. Device 10 is adapted to provide the user with the ability to strike a large number of baseballs and retrieve them in a short space of time. The batting practice apparatus 10 comprises a bat 12, a ball 14, and a tether 16. The tether 16 comprises a light fishing line having a strength of approximately 10 pounds test. The bat 12 includes a recess 18 formed near the large end of the bat to nestingly receive a spinning reel 20. The tether 16 is secured at an outer end to the ball 14 and the inner end of the tether is wound on a spool 22 of the spinning reel as shown in FIG. 2.

The recess 18 has an axis 26 which is perpendicular to the center line of the bat 12. An aperture 24 formed in the bottom of the recess 18 allows the tether 16 to pass from the ball 14 to the spinning reel 20. A grommet 25 is pressed in the aperture 24 to minimize friction on the tether as it passes through the aperture. Nylon makes an ideal material for the grommet 25. The spinning reel 20 pays out the tether 16 along the axis 26 which also defines the direction the flight of the ball takes when struck by that bat 12. This allows the ball 14 to be propelled from the bat with a minimum of resistance. This allows the ball to fly nearly as far as it would if it were untethered. The minimal resistance offered by the tether also allows the use of a very light tether such as a six to ten pound test spinning fish line.

It is important that the bat 12 have the same swing weight and feel as a bat that would be used in actual baseball game conditions. The weight of material removed to form the recess 18 should equal the weight of the spinning reel 20, if the bat 12 is to have an identical swing weight to its original. Weights 28 can be added or subtracted from the apparatus 10 to make precise adjustments in the swing weight of the bat and compensate for any difference in weight of the spinning reel 20 and the amount of material removed to form the recess 18.

Figure 3:
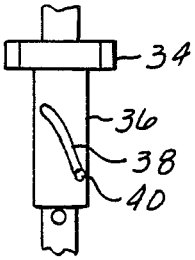
FIG. 3 illustrates a side view of the reel winding mechanism taken along line 3—3 of FIG. 2.
Figure 2:
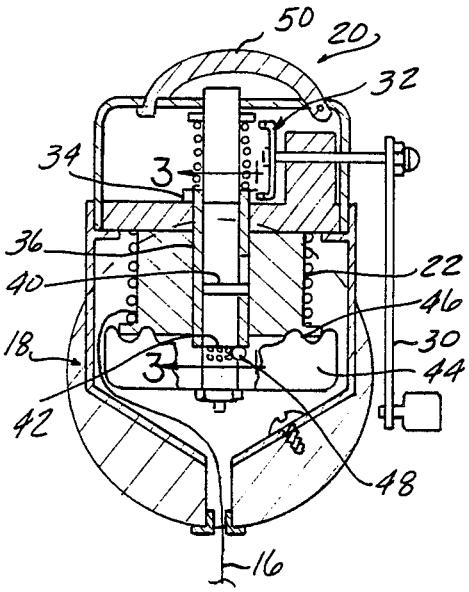
FIG. 2 illustrates a cross-sectional view of the reel taken along the line 2—2 of FIG. 1.

FIG. 2 of the drawing illustrates a cross-sectional view of the spinning reel 20 sectioned along the line 2—2 of FIG. 1. The spinning reel 20 comprises a crank 30 which drives a first gear 32. First gear 32 meshes with a second gear 34 which is rotatably attached to a sleeve 36. As shown in FIG. 3 of the drawing, the sleeve 36 includes a spiral slot 38, which carries a pin 40, which is pressed into a central shaft 42. When the sleeve 36 is rotated in a first direction, the pin 40 moves along the spiral groove 38 and moves the shaft 42 axially in a first direction. When the sleeve 36 is rotated in an opposed direction, the pin 40 moves along the spiral groove 38 in an opposed direction moving the shaft 42 the opposed direction. A cup 44 is secured to the end of shaft 42 and is adapted to rotate with the shaft 42. Scallops 46 formed in an open end of the cup 44 selectively engage the tether 16 to wind the tether on spool 22.

The spinning reel 20 is moveable from a first position or pay-out position as shown in FIG. 2 to a second position or winding position for winding the tether 16 on to the reel 22. In the pay-out position, as shown in FIG. 2, the tether is freely pulled from the spool 22 and is paid out with little resistance, since the scallops 46, are below the spool 22 and cannot engage the tether 16. A spring-loaded ball 48 detents the shaft 42 in the pay-out position. The shaft 42 is moved to the pay-out position by depressing a button 50. Winding in on the crank 3 moves the pin 40 along the spiral slot 38 and forces the shaft 42 upward to the winding position enabling the scallops 46 to engage the tether 16 and wind the tether on the spool 22.

Figure 4:
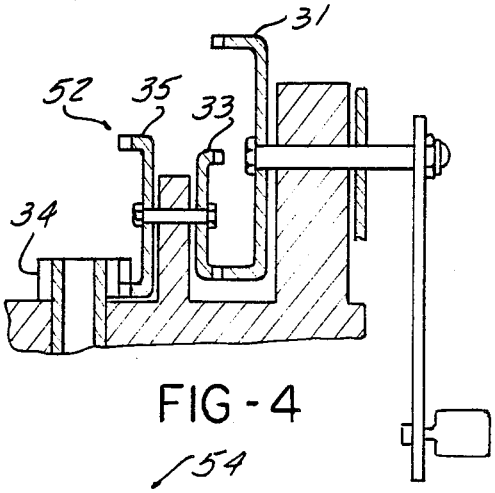
FIG. 4 illustrates a cross-sectional view of a gear step-up device for rapid retrieval of the tether.

Referring now to FIG. 4 of the drawing, there is illustrated a gear step-up mechanism which provides a rapid retreval of the ball 14 after it has been struck by the bat. Input gear 31 engages a first intermediate gear 33 which is half the diameter and has half the number of teeth that gear 31 possess. First intermediate gear 33 is coupled to second intermediate gear 35 having 50 percent more teeth than gear 33. The second intermediate gear 35 meshes with the second gear 34 to drive the sleeve 36 in the manner described herein above. Conventional spinning reels are configured to wind in at the pace of a relatively slow moving bait fish. It would be preferrable in the present invention to retrieve the ball 14 at about three times the speed that a conventional spinning reel winds in. The step-up gear mechanism illustrated in FIG. 4 provides the increased wind in speed that would be preferable.

Figure 5:
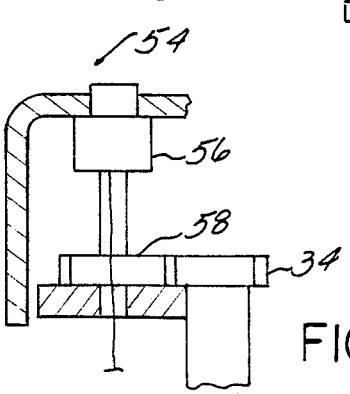
FIG. 5 illustrates a cross-sectional view of a counting device geared to the reel.

FIG. 5 illustrates at 54 a cross-sectional view through a portion of the spinning reel mechanism wherein a counting mechanism 56 is geared to the second gear 34 to provide an indication of the distance the ball 14 has traveled. A gear 58 is meshed with second gear 34 and drives the counting mechanism 56. By proper selection of the number of teeth on gear 58 a direct reading of distance traveled by the ball 14 can be obtained.

It can thus be seen that the present invention has provided a new and improved batting practice device, which when used, will provide many hours of recreational pleasure.

It should be understood by those skilled in the art of recreation devices that other forms of the applicants invention may be had, all comming within the spirit of the invention and the scope of the appended claims.

Having thus described my invention what I claim is:

1. A baseball batting practice apparatus, comprising:

a solid regulation baseball bat having a striking end portion;

a ball;

a spinning reel, having a tether retrieving spool, nestingly mounted in a receiving aperture in said striking end portion;

a tether having one of its ends attached to said ball and its other end attached to said retrieving spool and extending directly therefrom, through a pay-out bore in said striking end portion of said bat, in a direction perpendicular to the longitudinal axis of said bat and in the direction of ball flight, said spinning reel having adjustable resistance to maximize the distance of ball travel;

a plurality of weights, selectively added to the striking end portion of said bat, to compensate for weight lost from said receiving aperture, to make the swing weight the same as that of the original bat;

a counter geared to said retrieving spool for measuring the distance of ball travel.

* * * * *